US008371989B2

(12) United States Patent
Kim et al.

(10) Patent No.: US 8,371,989 B2
(45) Date of Patent: Feb. 12, 2013

(54) USER-PARTICIPATING TYPE FITNESS LECTURE SYSTEM AND FITNESS TRAINING METHOD USING THE SAME

(75) Inventors: Chong-Eun Kim, Seoul (KR); Uk Oh, Seoul (KR); Shin-Hyun Min, Gyeonggi-do (KR); Dane Jon, Seoul (KR)

(73) Assignee: SK C&C Co., Ltd., Gyeonggi-do (KR)

( * ) Notice: Subject to any disclaimer, the term of this patent is extended or adjusted under 35 U.S.C. 154(b) by 211 days.

(21) Appl. No.: 12/723,295

(22) Filed: Mar. 12, 2010

(65) Prior Publication Data

US 2011/0039659 A1 Feb. 17, 2011

(30) Foreign Application Priority Data

Aug. 13, 2009 (KR) ..... 10-2009-0074831

(51) Int. Cl.
*A63B 71/00* (2006.01)

(52) U.S. Cl. ..... 482/8; 482/1; 482/9; 482/901

(58) Field of Classification Search ..... 482/1–9, 482/900–902; 434/247, 257; 463/31–34; 473/156, 267

See application file for complete search history.

(56) References Cited

U.S. PATENT DOCUMENTS 5,249,967 A * 10/1993 O'Leary et al. ..... 434/247
5,342,054 A * 8/1994 Chang et al. ..... 473/156
6,231,527 B1 * 5/2001 Sol ..... 600/595
7,018,211 B1 * 3/2006 Birkholzer et al. ..... 434/257
7,121,945 B2 * 10/2006 Suganuma et al. ..... 463/34
7,679,689 B2 * 3/2010 Kitaura ..... 348/734
7,952,537 B2 * 5/2011 Allen et al. ..... 345/32
7,959,511 B2 * 6/2011 Kouno ..... 463/31
2010/0022351 A1 * 1/2010 Lanfermann et al. ..... 482/1
2010/0062869 A1 * 3/2010 Chung et al. ..... 473/131

FOREIGN PATENT DOCUMENTS

KR 10-0430840 5/2003

* cited by examiner

*Primary Examiner* — Glenn Richman
(74) *Attorney, Agent, or Firm* — Kevin L. Daffer; Daffer McDaniel, LLP

(57) ABSTRACT

The present invention relates to a user-participating type fitness lecture system and a fitness training method using the same. More specifically, the present invention relates to a user-participating type fitness lecture system that provides direction for correcting a user's posture or motion by comparing the user's motions with user created contents (UCC). When the contents are played back for the user to emulate, correctness of the user's motion is grasped by detecting and comparing motions in the contents with the user's motion photographed through a camera, and providing the user with posture correction information in image or voice formats. In one embodiment, a user-participating type fitness lecture system according to the present invention comprises a user terminal for photographing a user and transmitting a moving image of the user while playing back a UCC selected by the user; and a posture correction server for providing the user terminal with the UCC selected by the user, receiving the moving image from the user terminal, comparing the moving image with the played back UCC, and directing correction of the user's posture in voice or image.

20 Claims, 4 Drawing Sheets

USER-PARTICIPATING TYPE FITNESS LECTURE SYSTEM AND FITNESS TRAINING METHOD USING THE SAME

PRIORITY CLAIM

The present application claims priority to Korean Patent Application No. 10-2009-0074831 filed Aug. 13, 2009.

BACKGROUND OF THE INVENTION

1. Field of the Invention

The present invention relates to a user-participating type fitness lecture system and a fitness training method using the same, and more specifically, to a user-participating type fitness lecture system accomplished by comparing user's motions with user created contents (UCC) or user generated contents (UGC), in which when contents shared in Web 2.0 environment represented by UCC or UGC are played back, correctness of user's motion is grasped by detecting motions in the contents and detecting the user's motion photographed through a camera, thereby providing the user with correct fitness posture in image or voice and detecting and providing an amount of exercise of the user, and a fitness training method using the fitness lecture system.

2. Description of the Related Art

The following descriptions and examples are given as background only.

Recently, TV lecture programs, video lecture programs, and the like are diversely provided so that users may not be restricted by time and space in learning a sport that mainly requires motions, such as weight training, aerobic, Taekwondo, fencing, dancing, or the like. However, such programs are one-sided transfer-type educational programs and, thus, it is difficult to confirm whether the user's motions are correct and impossible to measure how correctly the user copies the correct motions portrayed in the program.

Korean Patent No. 430,840 relates to an exercise apparatus for correcting user posture by comparing the user's motions with a standard image. The exercise apparatus described in the Korean patent comprises a PC camera, a monitor, a speaker, a main body capable of playing a CD loaded with an exercise lecture program and a motion comparison engine, a screen, and a mat.

However, since the Korean patent uses a method of comparing motions for determining existence or not of signals in a unit area by logically dividing an area in order to compare the user's motions with a standard image, it is inconvenient in that the size and position of the standard image should always be matched to those of a user's image. In addition, if the external shape of the user is greatly different from the standard image, the images cannot be matched to each other, and thus, the motions cannot be correctly compared. Therefore, there is a problem in that although the user performs the correct motion, directive comments requesting the user to correct the posture are outputted frequently.

In addition, since the user uses a CD loaded with an exercise lecture program and a motion comparison engine, it is inconvenient in that the user should purchase a CD every time in order to exercise contents desired by the user. Also, since a separate screen for blocking a real background of the user is needed in order to match a separate background to an image using a chromakey technique, there is a restriction in the exercise space.

In addition, there is a problem in that the exercise lecture program described in the Korean patent simply copies a motion and lacks of funny factors that can be obtained in the process of exercise.

SUMMARY OF THE INVENTION

The following description of various embodiments of a user-participating type fitness lecture system and method of using the fitness lecture system is not to be construed in any way as limiting the subject matter of the appended claims.

According to one embodiment, a user-participating type fitness lecture system is provided for comparing user motions with user created contents (UCC). When the contents, which are shared in a Web-enabled environment, are played back, correctness of the user's motion is grasped by detecting and comparing motions in the contents with the user's motion photographed through a camera, and providing the user with correct fitness posture in image or voice. In some cases, the fitness lecture system may also detect and provide an amount of exercise performed by the user. A fitness training method using the fitness lecture system is also provided herein, along with a method of enjoying the exercise by adding interesting factors in order to enhance the pleasure of exercise.

According to one aspect of the present invention, a user-participating type fitness lecture system is provided for comparing a user's motions with user created content (UCC). In general, the user-participating type fitness lecture system comprises a user terminal for photographing a user and transmitting a moving image of the user while playing back a UCC selected by the user. In addition, the user-participating type fitness lecture system comprises a posture correction server for providing the user terminal with the UCC selected by the user, receiving the moving image from the user terminal, comparing the moving image with the played back UCC, and directing correction of the user's posture in voice or image.

According to another aspect of the present invention, a fitness training method is provided for a user who is connected to a user-participating type fitness lecture system. In one example, the method comprises the steps of providing the user with a UCC list; selecting, by the user, UCC from the UCC list; converting an analog image of the user into a digital image; analyzing and comparing the digital image of the user with the UCC selected by the user and played back for the user to view; generating posture correction information for the user through a result of the comparison; and providing the generated posture correction information to the user in image or voice.

BRIEF DESCRIPTION OF THE DRAWINGS

Other objects and advantages of the invention will become apparent upon reading the following detailed description and upon reference to the accompanying drawings in which.

Figure 1A:
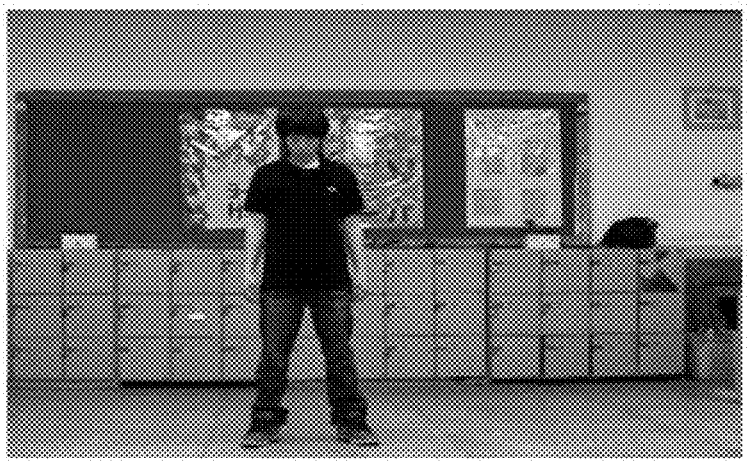
FIGS. 1A-C are photographs illustrating a series of images that may be utilized in a motion tracking method used in the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF THE PREFERRED EMBODIMENT

Hereinafter, preferred embodiments of the present invention will be described in detail with reference to the accompanying drawings.

Figure 1B:
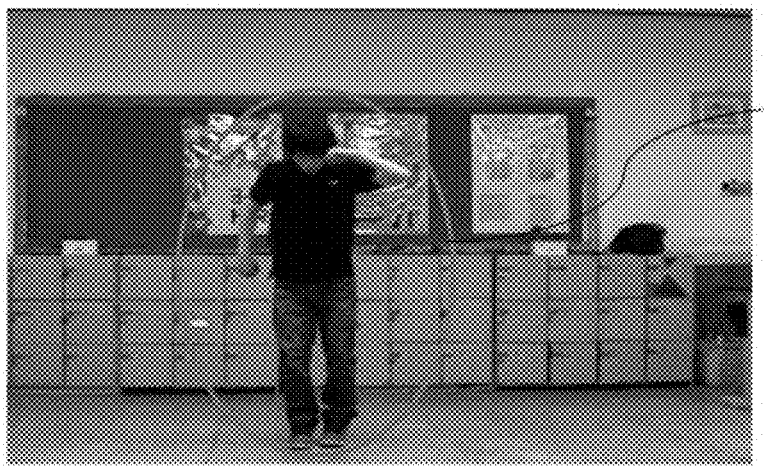
Figure 1C:
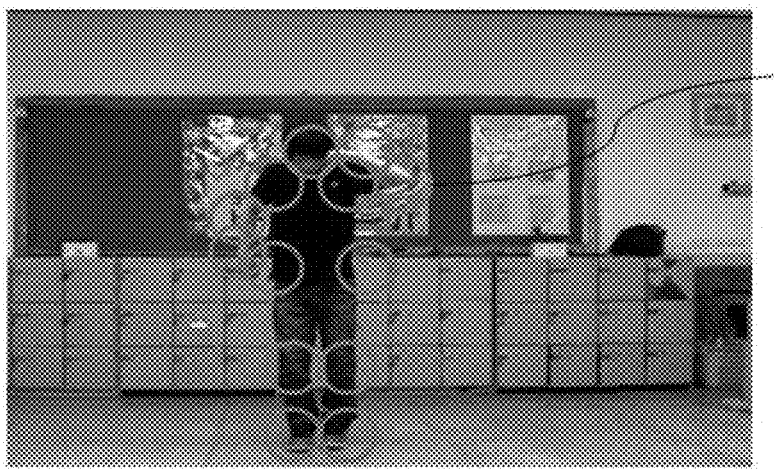

FIGS. 1A-C are photographs illustrating a series of images that may be used in a motion tracking method employed by the present invention. Motion tracking is an image processing technique, which compares a series of images, separates the images into a mobile part and a fixed part, and tracks down a trajectory along which the mobile part moves. In this manner, motion tracking provides a method of analyzing an activity area of a user.

As shown in FIG. 1A, the motion tracking method uses a camera to photograph a screen in a standing-still state and recognize the screen as a background screen of the entire image. Then, if a user moves within a recognition range of the camera, the memorized background screen and user's motions are recognized as different parts, and it is determined that an object (the user) is moving. If existence of the user is recognized as shown in FIG. 1B, a user's activity area 110 where the user's motions can be detected is set within the entire screen. As shown in FIG. 1C, markers 120 are set on featured parts of the user's body from which the user's motions can be grasped within the set activity area 110. As shown in FIG. 1B, an area slightly extending from the entire position of the user is set as the user's activity area 110. As shown in FIG. 1C, the markers 120 are set on various parts of the user's body, such as the head, shoulders, back, arms, hands, waist, legs, feet, and the like, from which the user's motions can be recognized when the user moves.

Thereafter, consecutive images of the parts set with the markers 120 are tracked down by comparing images photographed in respective frames, whereby a trajectory of the user's motions is rendered with respect to time, motion, speed, angle, position, and the like of the user are determined based on the trajectory.

Figure 2:
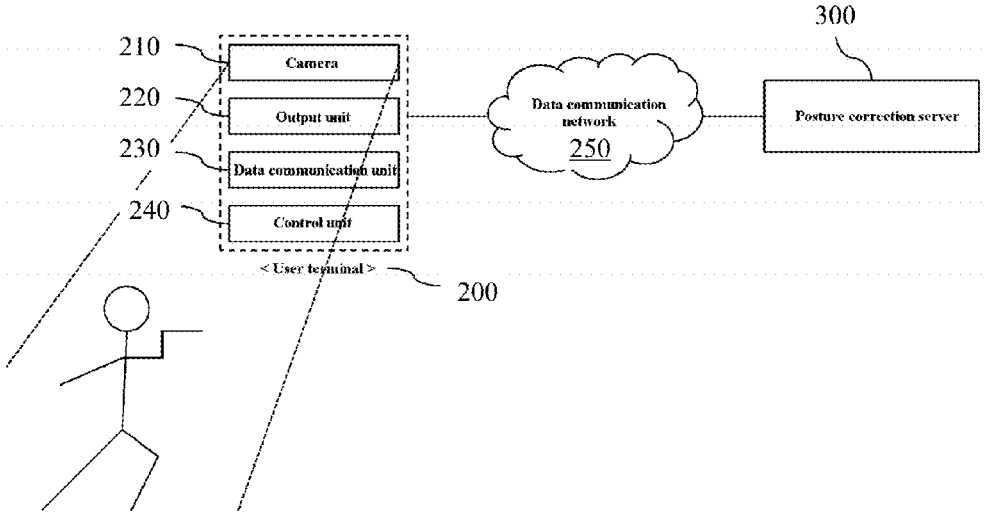
FIG. 2 is a block diagram illustrating one embodiment of a user-participating type fitness lecture system that may utilize the motion tracking method demonstrated in FIGS. 1A-C.

FIG. 2 is a block diagram showing one embodiment of a user-participating type fitness lecture system accomplished by comparing a user's motions with user created content (UCC) utilizing the motion tracking method mentioned briefly above.

As shown in FIG. 2, the user-participating type fitness lecture system comprises a user terminal 200 connected to a posture correction server 300 through a data communication network 250. The user terminal 200 comprises a camera 210 to photograph a user and various units for transmitting a moving image of the user while playing back user created content (UCC). As will be described below in reference to FIG. 3, the posture correction server 300 comprises components for providing the UCC selected by the user, receiving a user motion image from the user terminal 200, analyzing the user's motions, and providing posture correction information and an amount of exercise calculated by comparing analyzed motion data with the played back UCC.

An exemplary embodiment for using the fitness lecture system shown in FIG. 2 may now be described. First, the user connects to the posture correction server 300 and selects and plays back a desired UCC. At the same time, the user terminal 200 photographs and transmits images of a background screen and the user's motion to the posture correction server 300. The posture correction server 300 extracts the user's motion from the received images and compares motions of the currently played back UCC with the user's motion in real-time. If the user's motion is incorrect, or if the user's posture is different from that of the UCC, correction is directed in image or voice so that the user may take a correct motion. If playback of the UCC is completed, the posture correction server 300 displays the amount of exercise in a value of measured calories and/or registers a user motion image as UCC in response to a user's request (see, e.g., FIG. 4).

In one embodiment, the data communication network 250 may comprise an Internet network using, for example, a TCP/IP protocol capable of wired connection, HSDPA and W-CDMA protocols capable of wireless connection, and the like.

Returning to FIG. 2, the user terminal 200 comprises a camera 210 for focusing on a target of posture correction, such as the whole or a part of the user's body; an output unit 220 for outputting the UCC selected by the user and directions for correcting the user's posture in image and voice; a data communication unit 230 for connecting to the posture correction server 300 in a wired/wireless connection through the data communication network 250; and a control unit 240 for transmitting the image photographed by the camera 210 to the posture correction server 300 through the data communication unit 230.

As the primary function of the camera 210 is to photograph the user's motions, a small-sized camera using a charge-coupled device (CCD) can be provided as the camera. However, the number of frames per second is preferably 25 or more in order to analyze the user motions. Although the camera 210 can be provided in the main body of the user terminal 200 as a single body, it can also be provided as a separate device independent from and mounted to the main body of the user terminal 200. When the camera is mounted on the main body of the user terminal 200, it is generally preferable for the camera to have a variable photographing angle.

In general, the posture correction server 300 provides the requested UCC, compares and analyzes the images of the received user's motions and the motions of the played back UCC, and directs correction of posture in image or voice in real-time so that the user may perform a correct motion. One embodiment of the posture correction server 300 will be described in further detail in reference to FIG. 3.

Figure 3:
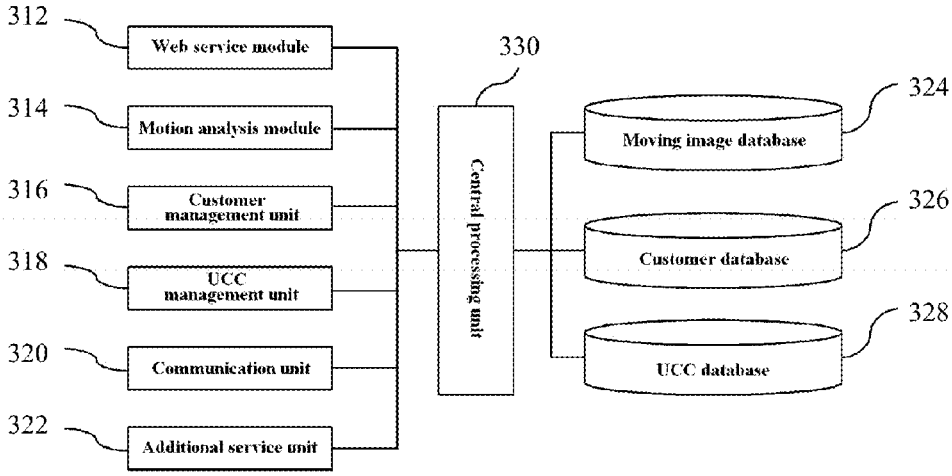
FIG. 3 is a block diagram illustrating one embodiment of the posture correction server shown in FIG. 2.
Figure 4:
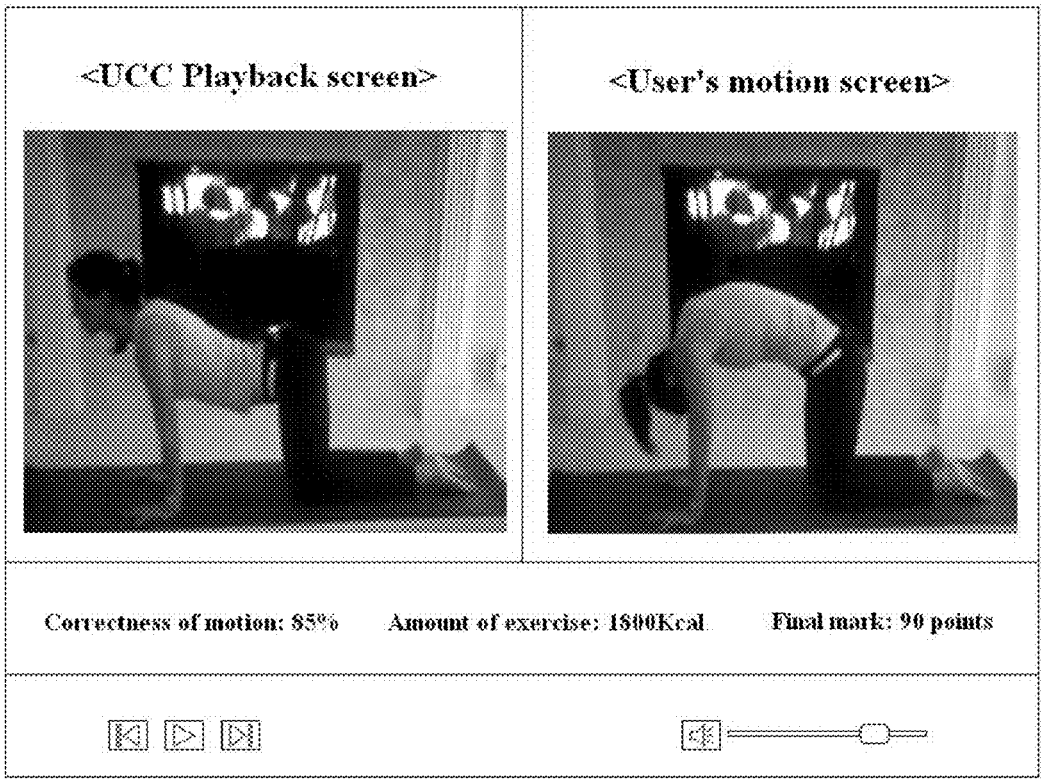
FIG. 4 is an artist's rendering of a UCC playback screen window according to an embodiment of the present invention.

FIG. 3 is a block diagram illustrating one embodiment of the posture correction server 300 shown in FIG. 2. FIG. 4 is an artist's rendering of an exemplary UCC playback screen window according to an embodiment of the present invention.

As shown in the embodiment of FIG. 3, the posture correction server 300 comprises a web service module 312, a motion analysis module 314, a customer management unit 316, a UCC management unit 318, a communication unit 320, an additional service unit 322, a moving image database 324, a customer database 326, a UCC database 328, and a central processing unit 330.

The web service module 312 provides a membership registration service (typically, in a web browser form), so that a user connected through the wired/wireless Internet may join as a member. The web service module 312 also provides the user with a UCC list of various forms in connection with the UCC management unit 318. The UCC list generally comprises one or more UCCs, which are available for selection by the user. In addition, the web service module 312 provides a UCC playback screen (again, typically in a web browser form) in order to play back the UCC selected by the user.

FIG. 4 illustrates one embodiment of a UCC playback screen that may be presented to the user. As shown in FIG. 4, the UCC playback screen simultaneously provides a user motion image transmitted through the user terminal and the UCC selected by the user through a split screen split, which may direct the user to correct his/her posture through image or voice commands. In addition, the UCC playback screen allows the user to split the screen in a desired size and ratio according to a user's key input.

The motion analysis module 314 shown in FIG. 3 converts the user motion image, which is an analog image transmitted from the user terminal 200, into a digital image, stores the digital image in the moving image database 324, and analyzes the digitalized user motion image. In one embodiment, the motion analysis module 314 calculates the correctness of the motion (expressed, e.g., in percentage), and possibly the speed and angle, position, and the like of the user, by analyzing and comparing the user motion image and the played back UCC at regular intervals. The motion analysis module 314 transmits the analysis results to the central processing unit 330. When playback of the UCC is completed, the motion analysis module 314 may also calculate the amount of exercise performed by the user based on the analysis of the user's motion.

The UCC management unit 318 manages the UCC database 328, in which the UCC list and UCC are stored, and provides the user terminal 200 with the UCC selected by the user through the web service module 312. In addition, the UCC management unit 318 may register a user motion image as a new UCC by storing the user motion image stored in the moving image database 324 in the UCC database 328 in response to a user's request, so that other users may play back the new UCC.

Here, the term user created content (UCC) refers to contents mostly made up of moving images and may include all kinds of moving images that can be used to compare and correct a variety of different user motions, such as those performed in sports, dancing, playing a musical instrument, and practice of acting. The UCC is stored together with additional information such as the field of the UCC, the difficulty of motion, the amount of calorie consumption, the effect of exercise, and the like, so as to be a reference for a user to select a moving image.

If a new customer joins as a member through the web service module 312, the customer management unit 316 creates a new database record in the customer database 326 and stores information about the new customer, such as the name, sex, age, occupation, height, weight, hobbies, interests, and the like, of the user. The communication unit 320 provides the network interface for performing wired/wireless communications with the user terminal 200.

The central processing unit 330 provides the user terminal with the UCC selected by the user through the web service module 312, receives a result of the comparison between the played back UCC and the user motion image through the motion analysis module 314, and provides the user with posture correction information in voice or image format if the user's posture is incorrect. Once playback of the UCC is completed, the central processing unit 330 receives the calculated amount of exercise of the user through the motion analysis module 314, converts the amount of exercise into a caloric value, and provides the user terminal with the caloric value through the web service module 312.

In addition, as the details of posture correction are accumulated in the customer database 326 for a particular user, the central processing unit 330 may provide the user with additional recommendations and/or advice. For example, the central processing unit 330 may provide the user with UCCs recommended for the parts of the user's body that frequently require correction of posture. In addition, the central processing unit 330 may produce user's preference based on the customer information of the user and the additional information on the UCC, recommend a custom-tailored UCC, and/or provide advice for controlling exercise, so that the user may systematically correct posture and exercise through correct motions.

In some embodiments, the posture correction server 300 of the present invention may be provided with an additional service unit 322, such as a chatting module and a point calculation module so that a user may play a game with a plurality of other users while viewing the same screen. The chatting module allows the user to exchange information with a plurality of other users in a variety of methods, such as chatting, messenger, and short sentence service, while viewing the same screen. The point calculation module converts a result of comparing motions provided through the motion analysis module 314 into points and ranks the users based on the result converted into points.

In such an embodiment, the web service module 312 would maintain synchronization with the chatting module, collect screen information of user terminals corresponding to the user and the plurality of other users, and provide the communicating users with the same screen. Accordingly, the user and the plurality of other users may correct posture through comparison of motions while viewing the same UCC through the same screen, and therefore, interest in the game is stimulated, advice among the users is encouraged, and competence among the users is induced.

Hereinafter, an embodiment of a fitness training method accomplished by comparing user's motions with user created content (UCC) will be described below in reference to FIG. 5. According to one embodiment, the fitness training method may be accomplished by using the system described above and illustrated in FIGS. 1-4. Although described herein as if the method were performed by the system specifically illustrated and described herein, it is noted that the fitness training method described below is not limited to such a system, and may be performed by alternative system configurations capable of performing such a method.

Figure 5:
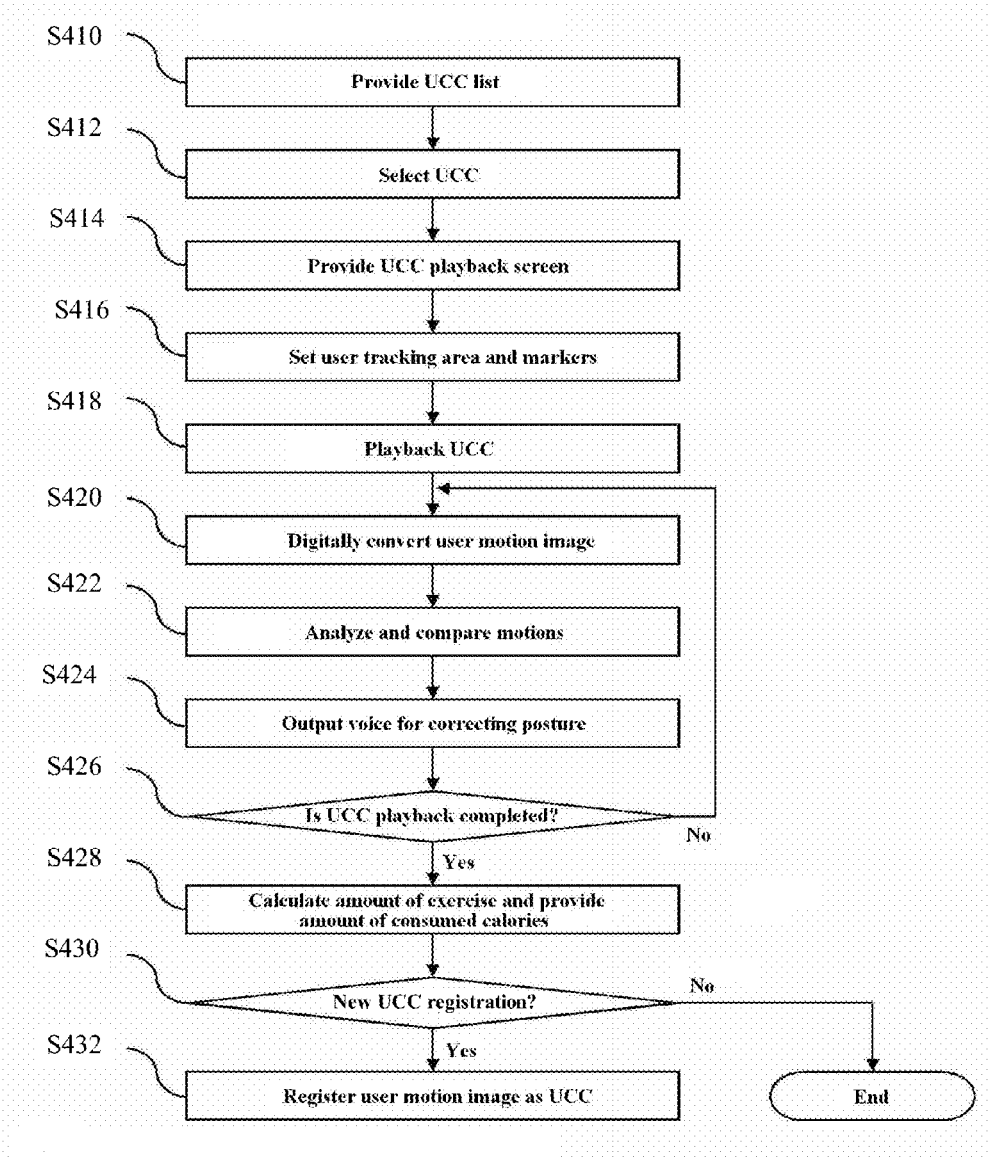
FIG. 5 is a flowchart illustrating an exemplary fitness training method accomplished by comparing user's motions with UCC according to an embodiment of the present invention.

FIG. 5 is a flowchart diagram illustrating one embodiment of a fitness training method accomplished by comparing a user's motions with user created content (UCC).

Prior to the method steps shown in FIG. 5, a user who is registered as a service member may connect and log into a posture correction server 300 through a wired/wireless Internet. If the user is registered and logged into the posture correction server 300, the web service module 312 of the posture correction server displays a UCC list in connection with the UCC management unit 318 (step S410), so that the user may select a desired UCC from the list (step S412). In some cases, the central processing unit 330 may provide a service recommending a custom-tailored UCC relevant to the user's preference and details of posture correction accumulated for that user.

Next, the web service module 312 provides a UCC playback screen (as shown, e.g., in FIG. 4), so that the user motion image received through the user terminal 200 and the UCC selected by the user can be simultaneously displayed on the same screen (step S414). Initially, the web service module 312 may show only a representative still screen of the UCC until the user presses the playback button on the UCC playback screen (see, FIG. 4). The still screen may enable the user to examine the position of the camera in the user terminal 200, and at the same time, allow the motion analysis module 314 to set an activity area and markers on the user (step S416).

If the user plays back the UCC (step S418), the motion analysis module 314 converts the analog image transmitted from the user terminal 200 into a digital image and stores the digital image in the moving image database 324 (step S420). In addition, the motion analysis module 314 creates frame images of the digitalized image screen and the played back UCC screen at regular intervals (e.g., every 5 frames), analyzes and compares motions in the frames, and transmits the results to the central processing unit 330 (step S422).

The central processing unit 330 receives the results of the comparison, generates posture correction information for the user and outputs the generated posture correction information to the user in an image or voice format (step S424). For example, as shown in FIG. 4, when the user does not raise the head and lower the waist as is instructed through the UCC Playback screen, a voice saying "raise the head and lower the waist" is outputted so that the user may easily recognize and correct the incorrect motions.

Once the playback of the UCC is completed (step S426), the motion analysis module 314 calculates the amount of exercise based on the analysis of the user's motion and transmits the amount of exercise to the central processing unit 330. The central processing unit 330 provides calories consumed by the user, correctness of the user's motions, or the like, to the user terminal 200 through the web service module 312 (step S428). In some embodiments, a user may wish to register the generated user motion image as a new UCC. If the user selects registration of a new UCC (Yes at step S430), the UCC management unit 318 stores the user motion image created in the moving image database 324 in the UCC database 328 and registers the user motion image as new UCC (step S432).

Since a user can practice motions of a desired moving image without restrictions on time and space or burdens of training fees and accompanying facilities, and correct posture in real-time by exactly grasping incorrect motions of parts of the body, the user-participating type fitness lecture system and fitness training method described herein are advantageous in that the user can enhance efficiency of posture correction and exercise.

Further, a user can practice motions of various fields without a need of separately purchasing contents. Also, since UCC is provided for the parts of the user's body that frequently require correction of posture, or custom-tailored UCC is recommended and advice for controlling exercise is provided based on user's preference, user's satisfaction can be maximized.

Furthermore, a user can correct posture through comparison of motions while viewing the same UCC together with a plurality of other users, and therefore, interest in the game is stimulated, advice among the users is encouraged, and competence among the users is induced.

The present invention described above is not limited to the aforementioned embodiments and the accompanying drawings. It will be apparent that those skilled in the art can make various modifications, changes and variations thereto without departing from the technical spirit of the invention.

What is claimed is:

1. A fitness training method for a user of a user-participating type fitness lecture system, comprising the steps of:

providing a user created content (UCC) list at a user terminal of the user-participating type fitness lecture system;

receiving selection of UCC from the UCC list at the user terminal;

converting an analog image of the user into a digital image;

simultaneously analyzing and comparing the digital image with the selected UCC via a server of the user-participating type fitness lecture system while the selected UCC is played at the user terminal;

generating posture correction information at the server for the user through a result of the comparison; and transmitting the generated posture correction information to the user terminal.

2. The method as recited in claim 1, wherein the step of providing the user with a UCC list provides a UCC list having custom-tailored UCC relevant to the user's preference and details of posture correction accumulated for that user.

3. The method as recited in claim 1, wherein the step of simultaneously analyzing and comparing the digital image of the user with the selected UCC comprises analyzing and comparing frame images of the digital image and the selected UCC at regular intervals.

4. The method as recited in claim 1, further comprising a step of calculating at the server an amount of exercise performed by the user and a step of transmitting the calculated amount of exercise to the user terminal.

5. The method as recited in claim 1, further comprising a step of inserting the digital image of the user into the UCC list in response to a user's request when playing the selected UCC is completed.

6. The method as recited in claim 1, further comprising a step of displaying the generated posture correction information at the user terminal.

7. The method as recited in claim 1, further comprising a step of presenting the generated posture correction information at the user terminal in a voice format.

8. A fitness training method for a user of a user-participating type fitness lecture system, wherein the method comprises:

comparing, via a server of the user-participating type fitness lecture system, a digital moving image of the user to a reference moving image stored upon the server;

generating posture correction information at the server for the user based on the comparison; and transmitting the generated posture correction information to a user terminal of the user-participating type fitness lecture system.

9. The method of claim 8, further comprising receiving selection of the reference moving image at the user terminal among a list of images displayed at the user terminal prior to the step of comparing the digital moving image of the user to the reference moving image.

10. The method of claim 8, further comprising presenting the generated posture correction information at the user terminal.

11. The method of claim 8, wherein the digital image comprises 25 or more frames per second.

12. The method of claim 8, further comprising calculating correctness of motion of the digital moving image relative to the reference moving image and transmitting the calculated correctness to the user terminal.

13. The method of claim 8, further comprising:

accumulating posture correct information for the user in the server;

generating additional posture correction information at the server for the user based on the accumulation; and transmitting the additional posture correction information to the user terminal.

14. The method of claim 8, further comprising:

receiving user entered information at the user terminal; and transmitting the user entered information to other user terminals of the user-participating type fitness lecture system.

15. The method of claim 8, further comprising converting results of the comparison into a point score.

16. The method of claim 15, further comprising ranking the user based on the point score relative to point scores of other users of the user-participating type fitness lecture system.

17. The method of claim 15, further comprising effecting game play among a plurality of users of the user-participating type fitness lecture system viewing the reference moving image.

18. A fitness training method for a user of a user-participating type fitness lecture system, comprising the steps of:

providing a user created content (UCC) list at a user terminal of the user-participating type fitness lecture system;

receiving selection of UCC from the UCC list at the user terminal; and inserting a digital image of the user into the UCC list in response to a user's request when playing the selected UCC at the user terminal is completed.

19. The method of claim 18, further comprising:

comparing the digital image of the user to the selected UCC via a server of the user-participating type fitness lecture system;

generating posture correction information at the server based on the comparison; and transmitting the generated posture correction information to the user terminal.

20. The method as recited in claim 18, further comprising calculating at the server an amount of exercise performed by the user and transmitting the calculated amount of exercise to the user terminal.

* * * * *